US008191497B2

(12) United States Patent
McCudden et al.

(10) Patent No.: US 8,191,497 B2
(45) Date of Patent: Jun. 5, 2012

(54) BANNER SUPPORT SYSTEM

(75) Inventors: Arthur Lachlan McCudden, Wahroonga (AU); Lachlan Arthur Dean McCudden, Wahroonga (AU)

(73) Assignee: Challangila Pty Ltd, New South Wales (AU)

( * ) Notice: Subject to any disclaimer, the term of this patent is extended or adjusted under 35 U.S.C. 154(b) by 412 days.

(21) Appl. No.: 12/449,281

(22) PCT Filed: Feb. 6, 2008

(86) PCT No.: PCT/AU2008/000146
§ 371 (c)(1),
(2), (4) Date: Jul. 31, 2009

(87) PCT Pub. No.: WO2008/095246

PCT Pub. Date: Aug. 14, 2008

(65) Prior Publication Data

US 2010/0064562 A1 Mar. 18, 2010

(30) Foreign Application Priority Data

Feb. 6, 2007 (AU) ..... 2007900564
Nov. 6, 2007 (AU) ..... 2007906100

(51) Int. Cl.
*G09F 17/00* (2006.01)
*E04H 12/32* (2006.01)

(52) U.S. Cl. ..... 116/173

(58) Field of Classification Search ..... 116/173, 116/174, 175; 40/601
See application file for complete search history.

(56) References Cited

U.S. PATENT DOCUMENTS

| | | | | | |
|---|---|---|---|---|---|
| 1,416,669 | A * | 5/1922 | Allman | 116/173 |
| 2,209,875 | A * | 7/1940 | Eichelsdoerfer et al. | 248/513 |
| 4,211,179 | A * | 7/1980 | Saunders | 114/90 |
| 4,791,878 | A * | 12/1988 | Lewis | 116/173 |
| 5,454,202 | A * | 10/1995 | van der Weijden | 40/606.09 |
| 5,983,825 | A * | 11/1999 | Nowak et al. | 116/173 |
| 6,227,683 | B1 * | 5/2001 | Tukia | 362/303 |
| 6,484,992 | B1 * | 11/2002 | Svensson et al. | 248/320 |
| 6,955,456 | B2 * | 10/2005 | Schroeder | 362/431 |
| 2003/0010274 | A1 * | 1/2003 | McCudden et al. | 116/173 |
| 2006/0118029 | A1 * | 6/2006 | Clark | 116/173 |

FOREIGN PATENT DOCUMENTS

| | | | |
|---|---|---|---|
| CH | 669058 | A5 * | 2/1989 |
| DE | 2457945 | A * | 6/1976 |
| DE | 3010029 | A1 * | 9/1981 |
| DE | 4141688 | A1 * | 6/1993 |
| DE | 20303861 | U1 * | 5/2003 |
| EP | 905335 | A1 * | 3/1999 |
| GB | 1485096 | A * | 9/1977 |
| GB | 2335072 | A * | 9/1999 |
| JP | 08165822 | A * | 6/1996 |
| WO | WO 2007022596 | A1 * | 3/2007 |

* cited by examiner

*Primary Examiner* — R. A. Smith
(74) *Attorney, Agent, or Firm* — Stinson Morrison Hecker LLP

(57) ABSTRACT

A system for supporting a banner includes a body defining an elongate passage (260, 260A) and a secure halyard passage (271, 271A), the elongate passage configured to receive at least one travelling weight (256, 256A) and having a longitudinal slot (261, 261A) extending substantially along the length of the elongate passage wherein, in use, the banner is attached through the slot to the at least one travelling weight. A housing (12) is positioned at an upper end of the halyard passage, the housing having a recess configured to receive a banner arm (14) wherein, in use, the banner is attached to the banner arm and retraction of a halyard (228) through the secure halyard passage causes the banner arm to be retracted into the recess and to be positioned in a predetermined laterally-extending orientation. The body may be a conduit (210) configured for attachment to a support surface. In another arrangement the body is a multi-function street pole (200A).

16 Claims, 8 Drawing Sheets

BANNER SUPPORT SYSTEM

FIELD OF THE INVENTION

The present invention relates generally to an apparatus for raising and supporting banners, flags and objects of a similar nature and to poles adapted to support the apparatus. In particular, the present invention relates to a banner-raising system that inhibits unauthorised interference with the raised object.

BACKGROUND OF THE INVENTION

Banners, flags and objects of a similar nature are widely used to convey information or to add visual interest. Such banners are typically suspended in prominent positions and sufficiently high that the banner is visible from some distance. Devices such as flag poles, whether standing on the ground or mounted on a wall, building or other surface, can be used to suspend banners. Street poles are also used to support banners. Due to the visibility, symbolic significance and, typically, public accessibility of banners, they are often the target of unauthorised operation or tampering such as vandalism or theft.

A halyard is often used for attaching the banner to a supporting pole at some height. A user attaches the banner to the halyard at ground level and then raises the banner to the appropriate height using the halyard and an elevated guiding arrangement. A disadvantage of the halyard is that a thief or vandal can also access the halyard at ground level and use the halyard to lower and steal or vandalise the banner.

Another way of replacing a banner is to engage cherry pickers that raise workers to manually attach or replace a banner to a street pole. Disadvantages of using cherry pickers include unsafe working conditions for the workers, significant costs and considerable disruption to pedestrian and vehicular traffic. The banners often have to be changed late at night when traffic is minimal.

There is an ongoing need for banner support systems that permit the banner to be readily raised into position and displayed while limiting the vulnerability of the banner to theft or vandalism.

Any discussion in the present specification of documents, publications, acts, devices, materials and the like is included for the purpose of providing a context for the present invention and is not an admission that the subject matter of the discussion forms part of the prior art base, or is part of the common general knowledge in Australia or any other jurisdiction.

SUMMARY OF THE INVENTION

According to a first aspect of the invention there is provided a system for supporting a banner comprising:

(a) a body defining an elongate passage and a secure halyard passage, the elongate passage configured to receive at least one travelling weight and having a longitudinal slot extending substantially along the length of the elongate passage wherein, in use, the banner is attached through the slot to the at least one travelling weight;

(b) a housing positioned at an operatively upper end of the elongate passage and halyard passage, the housing having a recess configured to receive a banner arm wherein, in use, the banner is attached to the banner arm and retraction of a halyard through the secure halyard passage causes the banner arm to be retracted into the recess and to be positioned in a predetermined laterally-extending orientation.

The body may be a street pole, or a conduit adapted to be mounted to a support surface.

According to a second aspect of the invention there is provided a street pole adapted to support one or more electrical fittings, signals, signs, lights, or electrical conduits, and also adapted to support a banner, the street pole comprising:

a cylindrical self-supporting wall defining a hollow core, the wall being shaped to define at least one vertically extending elongate passage which is configured to receive a travelling weight, the elongate passage having a longitudinal slot open to the exterior of the street pole extending the length of the elongate passage; and at least one halyard passage configured to receive a halyard, the halyard passage extending the length of the elongate passage and being separate from the hollow core and the elongate passage.

According to a further aspect of the invention there is provided a street pole adapted to support one or more electrical fittings, signals, signs, lights, or electrical conduits, and also adapted to support a banner, the street pole comprising a cylindrical self-supporting wall defining a hollow core, the wall being shaped to define at least one vertically extending elongate passage which is configured to receive a travelling weight wherein the elongate passage having a longitudinal slot open to the exterior of the street pole and extending the length of the elongate passage.

According to a further aspect of the invention there is provided an apparatus for raising and lowering a banner, the apparatus comprising:

(a) an elongate conduit defining a secure halyard passage, the conduit adapted to be mounted to a support surface so as to extend generally vertically along the support surface;

(b) a secure enclosure located at an operatively lower end of the elongate conduit and containing a halyard fastener for releasably attaching a halyard;

(c) an arm for attaching the banner thereto, wherein in use the arm is attached to the halyard that passes through the secure halyard passage to the secure enclosure; and (d) a housing located at an operatively upper end of the elongate conduit, the housing having a passage therethrough, wherein retraction of the halyard through the passage and the secure halyard passage causes the arm to be retracted into the housing and to be positioned in a predetermined laterally-extending orientation for displaying the banner.

BRIEF DESCRIPTION OF THE DRAWINGS

Embodiments of the present invention are described below with reference to the accompanying drawings, in which.

DETAILED DESCRIPTION OF THE EMBODIMENTS

Banner Support System Having a Rotator Head

Figure 1:
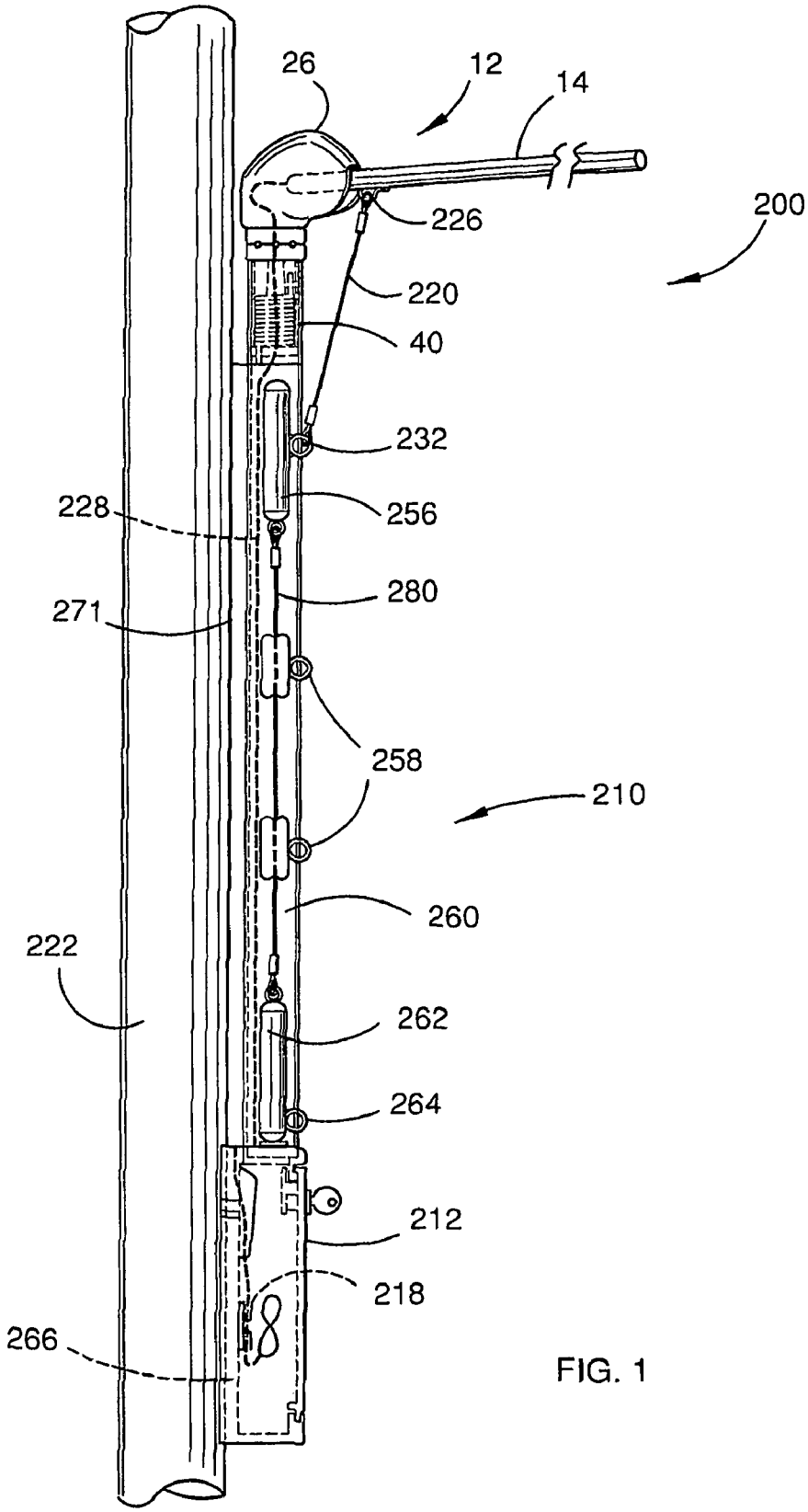
FIG. 1 shows a side view of a banner support system attached to a pole, the banner support system having a rotator head.

The banner support system 200 depicted in FIG. 1 includes an elongate banner-support conduit 210 surmounted by a head 12 that supports an arm 14 from which a banner may be suspended. In the arrangement of FIG. 1 the head 12 is able to rotate relative to the banner-support conduit 210. The banner support conduit 210 may be mounted to a structure such as a flag pole 222, or may be mounted to a generally vertical surface such as an exterior wall of a building. The banner support conduit 210 includes a secure halyard passage 271 which cannot be accessed externally.

Located at the operatively lower end of the banner-support conduit 210 is a secure enclosure 212 which contains a releasable halyard fastener 218. The lower enclosure 212 has sufficient internal volume to store the portions of the halyard that are not in use in the banner support conduit 210 while the banner support system is in its raised configuration. An opening in the operatively upper end of the enclosure 212 provides internal access from the interior of the enclosure 212 to the secure halyard passage 271. Preferably, the banner support conduit 210 abuts, inserts into or joins onto the enclosure 212 so that access to the secure halyard passage 271 is only available from the interior of the lower enclosure 212.

Rotator head 12 is mounted at the operatively upper end of the banner-support conduit 210. The rotator head 12 is positioned relative to the banner support conduit 210 such that a halyard 228 in the secure halyard passage 271 may pass into a passage within the lower portion 40 of the rotator head 12. In use, an arm 14 fits into a recess in a housing 26 of the rotator head 12. A banner may be supported by the arm 14. The rotator head 12 permits the banner and arm 14 to rotate, for example while a wind is blowing. As described in more detail with respect to FIG. 2A, a torsion spring in the lower part 40 of the rotator head 12 limits the rotation of the arm 14 and acts to return the rotator head 12 to a neutral position as determined by the configuration of the torsion spring.

The banner support conduit 210 also includes an elongate passage 260 having an externally accessible longitudinal slot. A travelling weight 256 is moveable within the passage 260. An eyelet 232 is provided on the weight 256. The passage 260 extends downwards from the rotator head 12 in the direction of the lower enclosure 212. The passage 260 is preferably long enough to match a vertical length of the banners to be supported by the banner support system 200.

Weight 256 is connected to a second, operatively lower weight 262 by cord 280. The cord 280 may be formed of the same material as the halyard 228. The cord 280 and weight 262 are also positioned and moveable in passage 260. In one arrangement, weights 256, 262 are made of stainless steel. Two or more glides 258 are positioned at intervals along the cord 280. The glides may be formed of an acetal-based plastic. Each of the glides 258 has an eyelet attached. An eyelet 264 is also provided in weight 262. The length of the cord 280 may correspond to the vertical length of the banners to be supported by the banner support system 200.

An attachment means such as eyelet 226 is provided on the arm 14. The eyelet 226 may be linked to the eyelet 232 on weight 256 by a cord 220. The arm 14 is thus linked to the weight 256. In one arrangement the cord may be attached to an eyelet by a spring.

When the banner support system 200 is in the raised position illustrated in FIG. 1, the arm 14 extends laterally from the banner-support conduit 210. For example, the raised arm 14 may be approximately orthogonal to the banner support conduit 210. The arm 14 may be inserted into a pocket in an operatively upper edge of the banner to be supported. A side edge of the banner may be connected to each of the eyelets on the glides 258 and the eyelets on weights 256, 262. Snap hooks on the banner may be used to connect the banner to the eyelets. Thus, in use, the arm 14 and weighted cord 280 hold an upper edge and one side of the banner. Weight 262, at an operatively lower end of cord 280, serves to tension the cord and thus limit movement of the banner.

An operatively upper end of halyard 228 is attached to arm 14. The halyard passes through the housing 26 and the lower portion 40 of the rotator head 12 and into the secure halyard passage 271. From the secure halyard passage 271, the. halyard 228 feeds into the lower enclosure 212. Within the lower enclosure 212 the halyard 228 may be attached to a releasable halyard fastener 218, which may, for example, be a cam cleat or a jam cleat. The remaining length of halyard 228 that is not accommodated in the secure halyard passage 271 or rotator head 12 is stored within an internal space of the lower enclosure 212. In the arrangement of FIG. 1, the lower housing 212 has a door which may be opened or locked using a key. The lower enclosure 212 thus serves to restrict unauthorised access to the halyard. A support bracket 266 may be positioned on the pole to provide additional strength for the lower enclosure 212.

In the arrangement shown in FIG. 1, the cord 280 is long enough that the operatively lower weight 262 can touch the lower enclosure 212. However, the length of the banner support conduit 210 may exceed the length of the cord 280, in which case the weight 262 need not be in contact with the lower enclosure 212 when the arm 14 is positioned in the rotator head 12.

To attach a banner, the arm 14 is lowered so that it can be accessed by a user, preferably at or near ground level. To lower the arm 14, the halyard 228 is released from the halyard fastener 218 and allowed to move up the secure halyard passage 271. The arm 14 and the weights 256, 262 descend under gravity, thereby pulling the released halyard 228 up the secure halyard passage 271. Once the arm 14 and weights 256, 262 have descended until they are accessible to the person attaching the banner, the person may attach the banner to the eyelets on weights 256, 262 and glides 258 and attach the arm 14 to the banner. The arm may, for example, be positioned in a pocket in the banner.

After attachment, the banner is raised using the banner support system 200. The user applies a force to a portion of the halyard 228 in the lower enclosure 212, thereby drawing the halyard 228 downwards through the secure halyard passage 271. The arm 14, which is attached to halyard 228, is consequently raised towards the housing 26. Cord 220 then draws the weight 256 upward in the passage 260 and cord 280 draws the glides 258 up the passage 260.

As described below in more detail with reference to FIGS. 2A and 2B, the arm 14 is drawn by halyard 228 into a recess in housing 26 and is held in position with arm 24 extending substantially orthogonally from the banner support conduit 210. The halyard 228 is then attached to the releasable halyard fastener 218, thereby retaining the banner support system 200 in the raised configuration shown in FIG. 1. The halyard 228 is preferably a type which will not stretch over time, for example a non-slump rope with a Kevlar core. In the raised position, the arm 14 and banner are preferable located at a height which prevents easy access by a person at ground level. The halyard is securely enclosed within the secure passage 271 and the lower enclosure 212 and cannot be accessed except through secure enclosure 212. Consequently, the banner support system 200 limits the possibility of the banner being lowered, tampered with or stolen.

When the banner is held in the raised position, movement of the edge of the banner parallel and proximate to the banner support conduit 210 is restrained by tension in cord 280 caused by the influence of gravity on weight 262. The structure of the passage 260 prevents movement of the weight 262 except in the direction defined by the passage 260. Weight 262 is preferably of sufficient mass to prevent appreciable movement of the edge of the banner parallel and proximate to the banner support conduit 210. For example, a 5 kg weight would be sufficient for a 2000×900 mm banner.

In the arrangement shown in FIGS. 1 and 2, the arm 14 may rotate about the axis defined by the banner support conduit 210 so that the raised banner can deflect under wind pressure, spilling the wind and thus limiting the force or bending moment resulting from the wind pressure.

In use, the banner support system 200 is mounted to a generally vertical support surface 222. The support surface 222 depicted in FIG. 1 consists of a solid pole. However, the banner support system 200 may be mounted to a support surface with virtually any characteristics. For example, the support surface may be a wall, column or other suitable structure and may be formed from a wide range of substances, including timber, concrete, metal and plastic. Furthermore, the support surface may be hollow. In an alternative configuration, the halyard does not pass through the secure passage 271 in the banner support conduit 210, but instead passes through a hollow space within the pole 222 or support surface. Preferably, the support surface is located in a position where the banner supported by the banner support system 200 is prominently visible to the intended audience.

The banner may be attached to the weights 256, 262 and cord 280 by several means, including a toggle and loop arrangement, hooks, carabiners or similar devices.

Figure 3:
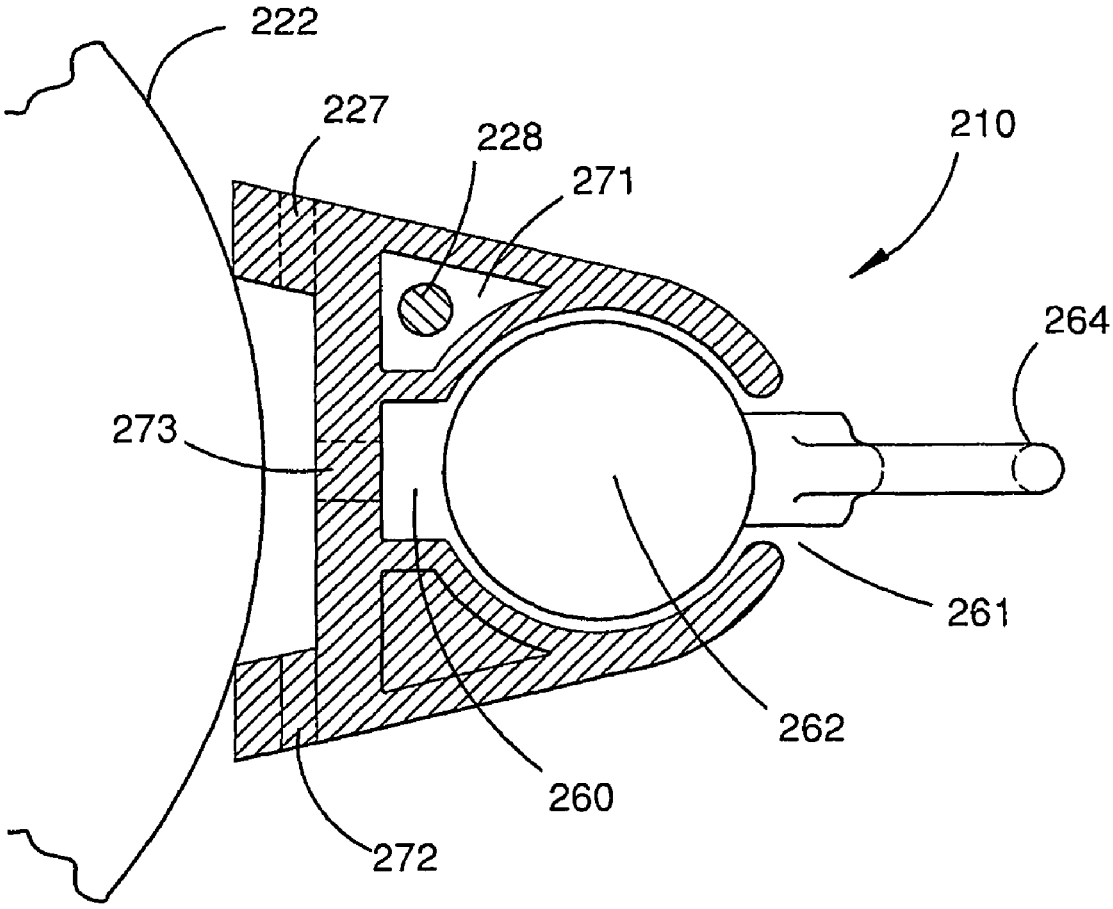
FIG. 3 shows a cross-sectional view of the banner-support conduit in the system of FIG. 1.

FIG. 3 shows a sectioned top view of the banner-support conduit 210. In the depicted arrangement, the banner-support conduit 210 has a plurality of elongated passages. The halyard 228 passes through the conduit 271 formed in the banner support system 210. Passage 260 accommodates the weights 256, 262 and the cord 280. FIG. 3 shows a top view of weight 262 with eyelet 264 attached. Passage 260 has a longitudinal slot 261 formed therein. Eyelet 264 protrudes through the longitudinal slot 261. The sides of the longitudinal slot defined in passage 260 provide some limitation of rotation of the eyelet 264 and consequently the attached banner. The longitudinal slot may thus define a neutral or equilibrium position of the banner when raised on the banner support system 200.

Slots 272 may be formed at intervals along the length of the banner-support conduit 210. One option for attaching the banner support system 200 to the pole 222 is to pass bandit clamps through the slots 272 and around the pole 222. The bandit clamps may be tightened and fastened to hold the banner support conduit 210 in place against the pole 222. Alternatively, or in addition, the banner-support conduit 210 may be attached to the pole 222 by other fastening means, for example a screw or nail passing through hole 273 in the banner-support conduit and the adjacent surface of the pole 222.

Figure 2A:
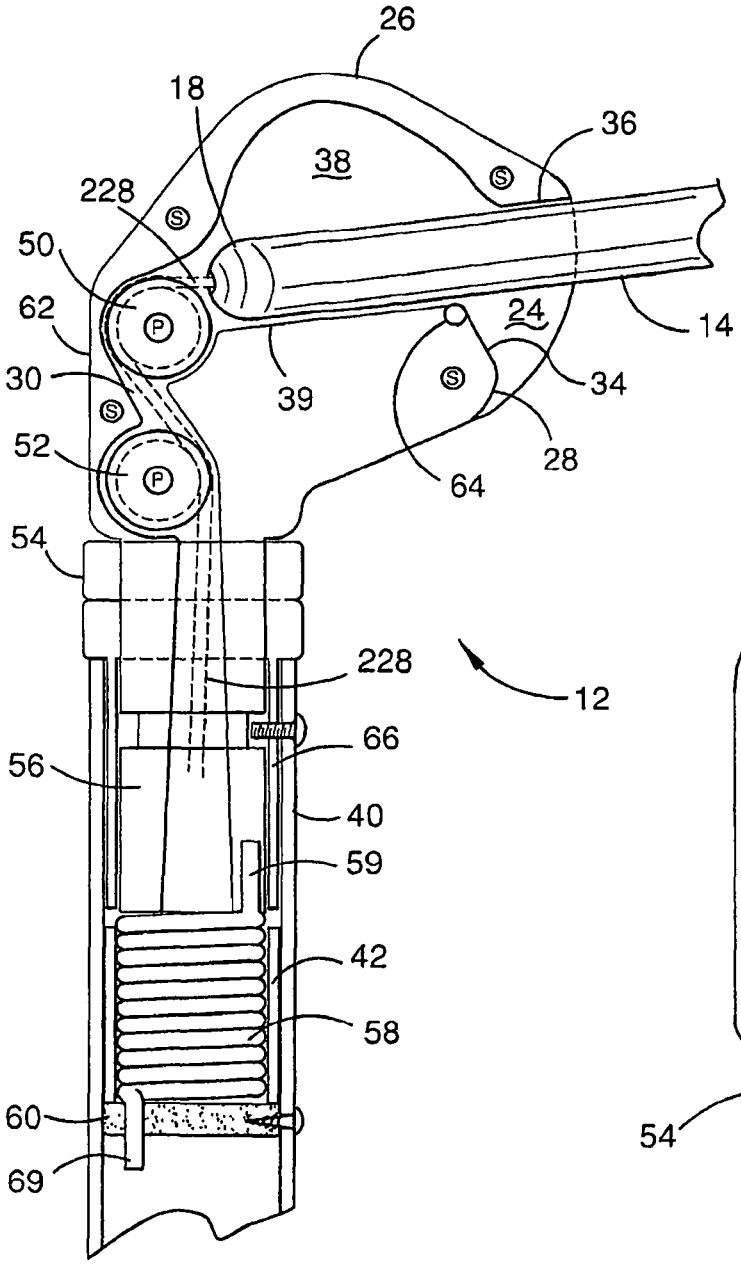
FIG. 2A shows a cut-away side view of the rotator head of the banner support system of FIG. 1.
Figure 2B:
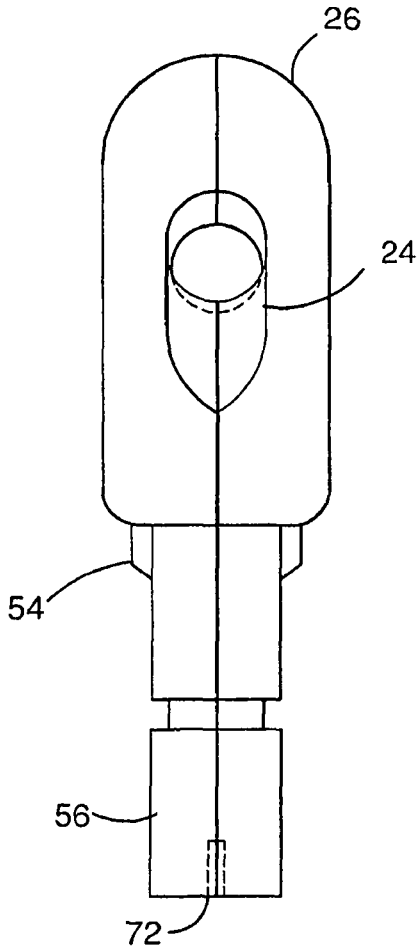
FIG. 2B shows an end view of the rotator head.

FIGS. 2A and 2B show the rotator head 12 in greater detail. The rotator head 12 includes a housing 26 positioned on a rotator cuff 54 and rotator support 56, which fit into a lower mountable part 40 of the rotator head 12. In turn, the mountable part 40 of the rotator head 12 is attached to the top end of the banner support conduit 210.

The rotator arrangement enables the housing 26 to rotate relative to the lower mountable part 40 and banner support conduit 210.

The housing 26 has a flat rear surface 62 that, in operation, is adjacent to the pole 222 or flat vertical surface on which the banner support system 200 is mounted. The flat rear surface 62 is shaped to limit the chance of the housing 26 striking the pole 222 as the housing 26 rotates. In one arrangement, the expected range of movement of the housing 26 (and hence arm 14) is less than or equal to 180°. Thus, if the banner support system 200 is mounted to a flat vertical surface, the arm 14 and the banner supported by the arm are restricted from hitting against the vertical surface. A torsion spring 58 is provided in the lower mountable part 40 and acts to resist rotation of the rotator head 12 and arm 14. The arrangement of the rotator head 12 with torsion spring 58 allows the banner to move, for example to spill wind, and also tends to return the arm 14 to a neutral or equilibrium position. In the neutral position, the arm 14 extends approximately orthogonally from the pole 222 or vertical surface on which the banner support system 200 is mounted. In the neutral position, the longitudinal slot 261 in the banner-support conduit 210 and the arm 14 define a plane in which the banner is suspended. The banner support conduit 210 is generally aligned with a vertical axis of the plane and the arm 14 defines a horizontal axis. In the present description, these axes are used as reference for spatially descriptive terms such as "vertical", "horizontal", "upwards" and "downwards".

The housing 26 has an opening 24 defined in a front end of the housing 26 opposite the flat rear surface 62. The opening 24 has a lower wall 34 and an upper wall 36. In use, the arm 14 is drawn into the housing 26 through the opening 24 by the halyard 228. The upper wall 36 and lower wall 34 serve to guide the arm 14 into the interior of the housing 26. In one arrangement, the upper wall is generally horizontal, and the lower wall 34 is angled upwardly and inwardly from the opening 24. The lower wall 34 has a rounded lower edge 28 towards the exterior that assists in guiding the arm 14 into the housing 26.

Within the housing 26 there is a chamber 38 in communication with the opening 24. The chamber 38 has a flat lower surface 39 that is approximately horizontal, or slightly angled upwards towards the opening 24. When the arm 14 is securely positioned within the housing 26, the surface 39 and the upper wall 36 of the opening 24 support the arm 14 and define the position of the arm 14, which is approximately orthogonal to the axis defined by the banner support conduit 210. The orientation of the arm 14 need not be exactly orthogonal. For example, the arm 14 may point slightly upwards in an approximate range of 0-10°.

The lower wall 34 extends upwardly and inwardly from lower edge 28 of opening 24. As the arm 14 is drawn into the housing 26 by halyard 228, the end 18 of the arm is guided by the angle of lower wall 34 into the chamber 38. In the chamber 38 the end 18 of the arm is rotated about point 64 (at the intersection of surface 39 and lower wall 34) by action of the halyard 228 until the end 18 rests against the flat lower surface 39. The upper wall 36 of the opening 24 restricts further upward rotation of the arm 14. The chamber 38 has a curved upper surface that has an approximately parabolic shape to accommodate the retraction of arm 14 into the housing 26 and the subsequent vertical rotation of the arm 14.

From the chamber 38, a passage 30 leads downwards through housing 26 and through the rotator cuff 54 and rotator support 56 into the lower tubular part 40 of the rotator head 12. The halyard 228 is attached to the end 18 of the arm 14. The halyard passes down passage 30 through the housing 26 and lower tubular part 40 into the secure halyard passage 271 and then into the lower enclosure 212. A downward force is applied to the halyard 228 in order to draw the arm 14 into the housing 26.

Two halyard guides 50 and 52 are provided in the passage 30 within the housing 26. The halyard guides 50, 52 may be wheels or pullies that rotate to reduce friction when the halyard 228 is moved in passage 30.

In use, the halyard 228 is released such that arm 14 is lowered closer to the level of the ground where the arm is accessible to a person mounting a banner. The banner is attached to arm 14 and the attachment means on the weights 256, 262 and glides 258 that move in the banner support conduit 210. The halyard 228 is then drawn downwards through the secure halyard passage 271. This raises the arm 14 upwardly until end 18 of arm 14 begins to enter opening 24 in the front face of housing 26. Continued retraction of the halyard 228 causes the end 18 of arm 14 to move into the housing and up along the wall 34. As the end 18 is drawn further into the chamber 38, the arm pivots about point 64 at the intersection of surfaces 39 and lower wall 34. Pivoting of the arm 14 continues until the arm 14 comes into contact with the upper wall 36 of the opening 24. The arm 14 may be retracted into the housing 26 until the arm is brought into contact with the entrance to the passage 30. Preferably the entrance is small enough to prevent the end 18 of arm 14 from entering the passage 30 and contacting the halyard guide 50.

If halyard 228 is loosened, the weight of arm 14 and the suspended banner causes arm 14 to rotate about point 64. End 18 of the arm rises into the chamber 38 and, as the halyard is further released, the arm 14 slides out of the housing 26 along the lower wall 34 of the opening 24.

As seen in FIG. 2A, the rotator support 56 is positioned within the lower tubular part 40 of the rotator head 12. In addition, the rotator support 56 may be enclosed in a bush 66 within the lower part 40. An end 59 of the torsion spring 58 is inserted into a recess 72 in the rotator support 56. The opposite end 69 of torsion spring 58 is held by a spring holding plate 60 that is attached within the lower tubular part 40. A support bush 42 may be positioned in the lower tubular part 40 around the torsion spring 58.

The torsion spring 58 is formed from a coiled wire that reacts against a twisting motion. As the housing 26 and arm 14 rotate, for example if a wind is blowing, the rotator support 56 also twists, thereby twisting the end 59 of the torsion spring 58. The more the spring 58 is twisted, the more force it takes to twist the spring still further. Thus, when the force of the wind eases, the torsion spring 58 acts to return the housing 26 and arm 14 to the neutral or equilibrium position defined by the configuration of the banner support system 200.

FIG. 2B shows an end view of the housing 26 and rotator support 56. The end view illustrates further how the opening 24 is shaped to provide a channel that guides the end 18 of arm 14 into the housing 26.

Frictional forces can be reduced by manufacturing the bushes 66, 42 from suitable plastics materials, for example from a self-lubricating polymer.

In an alternative configuration the housing 26 is fixed relative to the banner-support conduit 210 and thus the arm 14 is not able to rotate when the banner has been raised. The housing 26 has the same general shape to receive and support the laterally-extending arm 14. However, the non-rotating head differs from rotator head 12 in that no rotator cuff 54, rotator support 56 or torsion spring 58 is required.

Street Pole Incorporating a Banner Support System

The street pole described herein refers to the type of pole generally found in municipal areas. The street pole may perform a variety of other functions in addition to the function set out in this specification, for example the street pole may be used to support at least one of electrical fittings, signals, signs, flags, banners, lights and electrical conduits. The diameter of the street pole is typically between about 200 mm to 300 mm.

Figure 7:
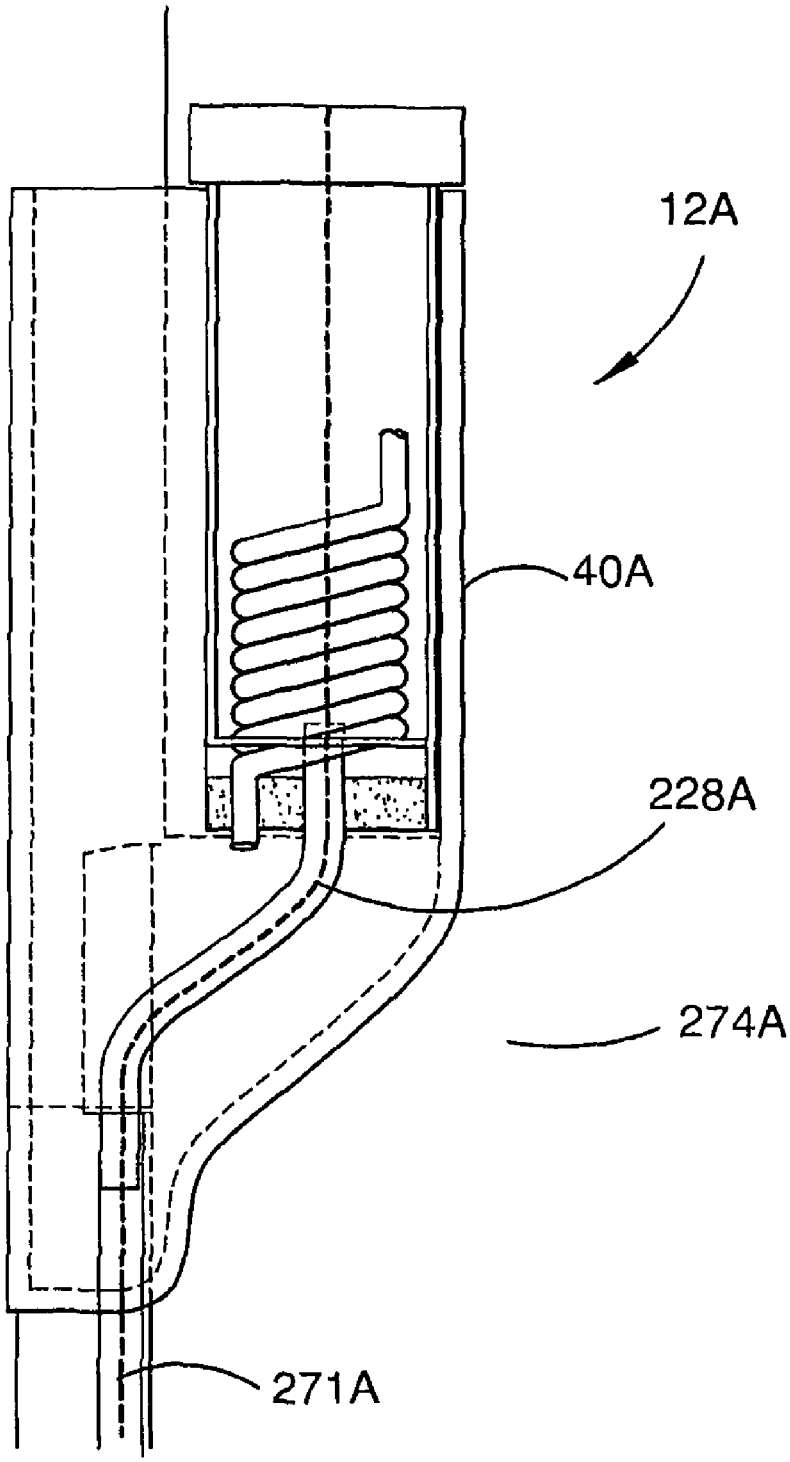
FIG. 7 shows a cut away side view of a mountable part of a banner support assembly.

FIG. 7 depicts a street pole 200A with a banner support assembly 12A attached, the street pole 200A comprising an elongate passage 260A with travelling weights 256A, 262A located in passage 260A, a halyard passage 271A extending parallel to the passage 260A and a secure enclosure 212A that contains a releasable halyard fastener 218A. The secure enclosure 212A is shown recessed into the interior of the pole, but an alternative arrangement would be for the enclosure to be mounted to the exterior of the pole. A device suitable for guiding the halyard from the interior of a pole to an externally-mounted enclosure is described in WO 2007/022596, published on 1 Mar. 2007, the disclosure of which is incorporated herein by cross-reference.

A banner support assembly 12A is mounted to the outside of the street pole 200A such that a halyard 228A may pass freely from the halyard passage 271A into the banner support assembly 12A (see FIG. 7). The banner support assembly comprises a mountable part 40A and a rotatable part 26A. The mountable part 40A of the banner support assembly 12A is secured to the street pole 200A using bolts, rivets, bandits or the like and the rotatable part 26A of the banner support assembly 12A is free to rotate in a manner more fully described in the discussion of FIG. 5A. In use, an arm 14A fits into an opening or recess 36A in the rotatable part 26A of the banner support assembly 12A. A banner may be supported by the arm 14A. The rotatable part 26A of the banner support assembly 12A permits the banner and arm 14A to rotate, for example while a wind is blowing. As described in more detail with respect to FIG. 5A and FIG. 7, a torsion spring 58A in the mountable part 40A of the banner support assembly 12A limits the rotation of the arm 14A and acts to return the rotatable part 26A of the banner support assembly 12A to a neutral or equilibrium position as determined by the configuration of the torsion spring 58A.

Figure 4:
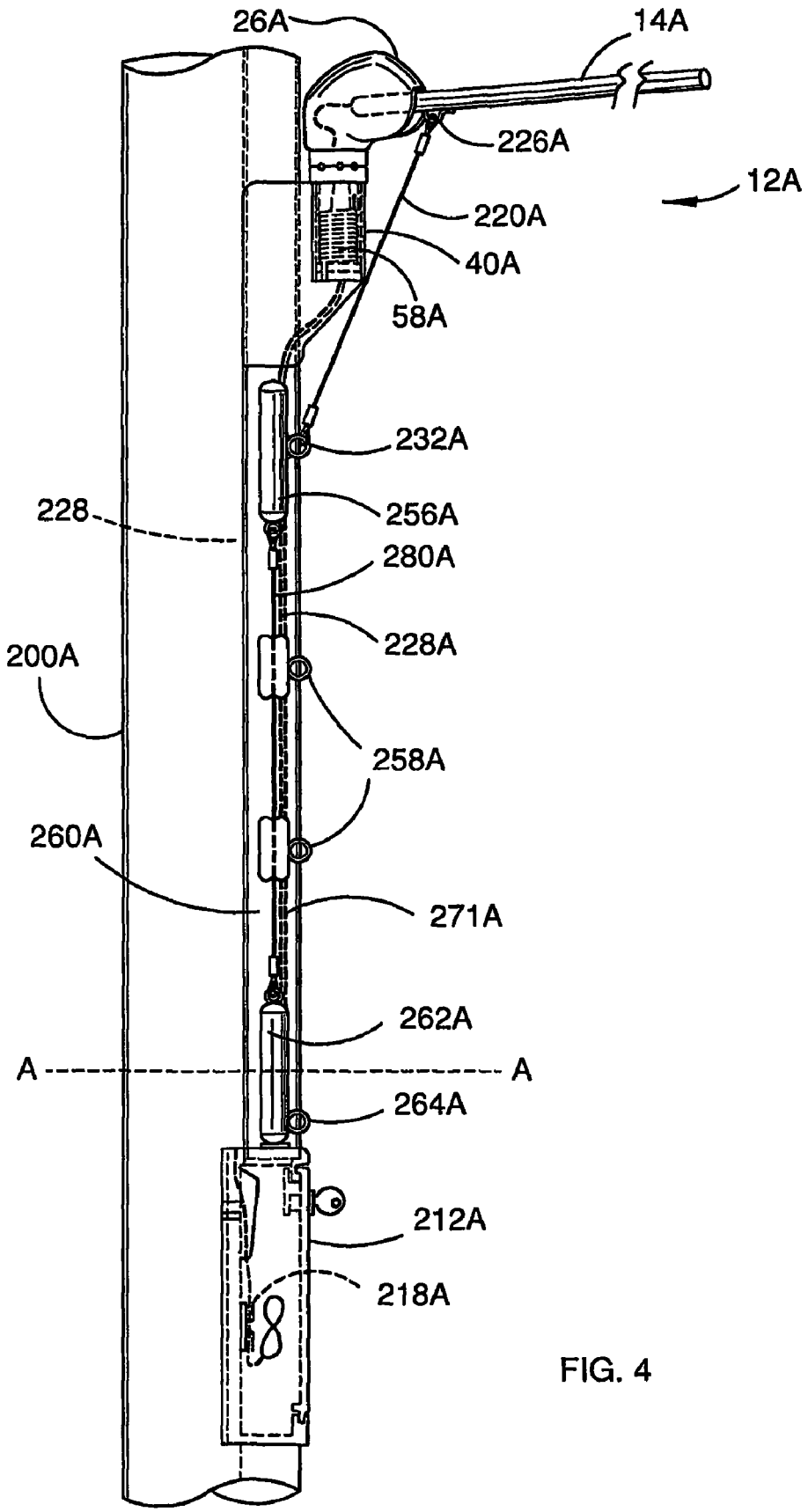
FIG. 4 shows a side view of a street pole with a banner support assembly attached.
Figure 8:
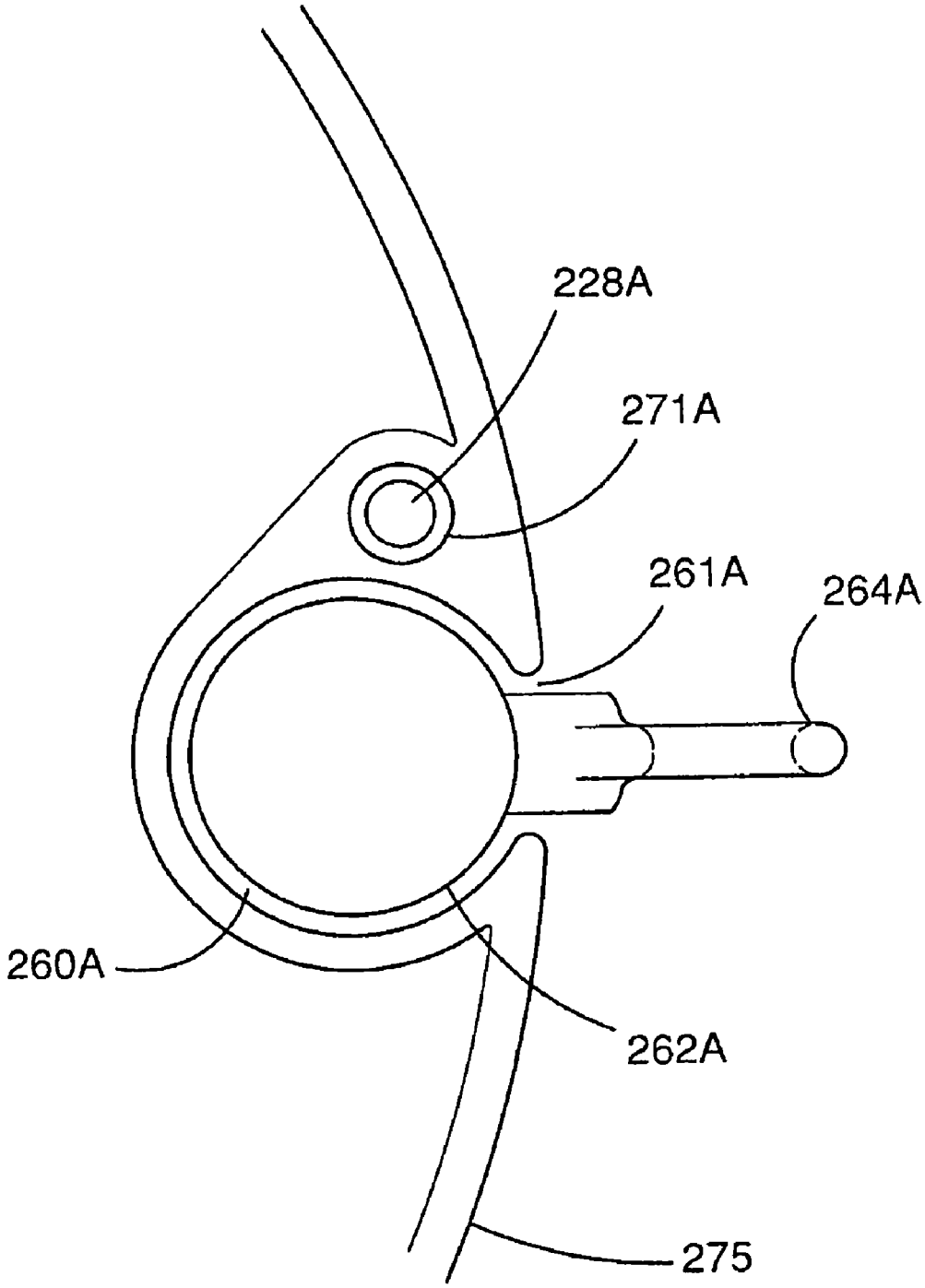
FIG. 8 shows a cross-sectional view along part of a street pole along line A-A depicted in FIG. 4.

Referring to FIG. 4 and FIG. 8, the street pole 200A includes an elongate passage 260A that has an externally accessible slot 261A. Weights 262A, 256A are moveable up and down the elongate passage 260A. An eyelet 232A is provided on the weight 256A. The weight 256A is connected to a second, operatively lower weight 262A by cord 280A. The cord 280A may be formed of the same material as the halyard 228A. The cord 280A and weight 262A are able to travel in the elongate passage 260A. In one arrangement, weights 256A, 262A are made of stainless steel. Two or more glides 258A are positioned at intervals along the cord 280A. The glides may be formed of an acetyl-based plastic. Each of the glides 258A has an eyelet attached. An eyelet 264A is also provided on weight 262A. A banner will, in use, be attached to the glides 258A.

An attachment means such as eyelet 226A is provided on the arm 14A. The eyelet 226A may be linked to the eyelet 232A on weight 256A by a cord 220A. The arm 14A is thus linked to the weight 256A.

When the banner is raised as illustrated in FIG. 4, the arm 14A extends laterally from the rotatable part 26A of the banner support assembly 12A. The raised arm 14A may be approximately orthogonal to the street pole 200A. The arm 14A may be inserted into a pocket in an operatively upper edge of the banner to be supported. A side edge of the banner may be connected to each of the eyelets on the glides 258A and the eyelets on weights 256A, 262A. Snap hooks on the banner may be used to connect the banner to the eyelets. Thus, in use, the arm 14A and weighted cord 280A hold an upper edge and one side of the banner. Weight 262A, at an operatively lower end of cord 280A, serves to tension the cord and thus limit movement of the banner.

Located at the lower end of the halyard passage 271A is a secure enclosure 212A that contains a releasable halyard fastener 218A. The lower enclosure 212A has sufficient internal volume to store the portions of the halyard that are not otherwise in use in the halyard passage 271A and banner support assembly 12A. An opening in the enclosure 212A provides internal access from the interior of the enclosure 212A to the halyard passage 271A. Preferably, the halyard passage 271A abuts, inserts into or joins onto the enclosure 212A so that access to the halyard passage 271A is only available from the interior of the lower enclosure 212A.

An operatively upper end of the halyard 228A is attached to arm 14A. The halyard passes through the rotatable part 26A and the mountable part 40A of the banner support assembly 12A and into the halyard passage 271A (see FIG. 4 and FIG. 7). From the halyard passage 271A, the halyard 228A feeds into the lower enclosure 212A. Within the lower enclosure 212A the halyard 228A may be attached to a releasable halyard fastener 218A, which may, for example, be a cam cleat. The remaining length of halyard 228A that is not accommodated in the halyard passage 271A or banner support assembly 12A is stored within an internal space of the lower enclosure 212A. In the arrangement of FIG. 4, the lower enclosure 212A has a door in the pole wall 275 which may be opened or locked using a key. The lower enclosure 212A thus serves to restrict unauthorised access to the halyard.

To attach a banner, the arm 14A is lowered so that it can be accessed by a user, preferably at or near ground level. To lower the arm 14A, the halyard 228A is released from the halyard fastener 218A and allowed to move up the halyard passage 271A. The arm 14A and the weights 256A, 262A descend under gravity, thereby pulling the released halyard 228A up the halyard passage 271A. When the arm 14A and weights 256A, 262A have descended and are accessible to the person attaching the banner, the person may attach the banner to the eyelets on weights 256A, 262A and glides 258A and attach the arm 14A to the banner. The arm may, for example, be positioned in a pocket in the banner.

To raise the banner, the user applies a force to a portion of the halyard 228A in the lower enclosure 212A, thereby drawing the halyard 228A downwards through the halyard passage 271A. The arm 14A, which is attached to halyard 228A, is consequently raised towards the rotatable part 26A of the banner support assembly 12A. The cord 220A then draws the weight 256A upward in the elongate passage 260A and cord 280A draws the glides 258A up the elongate passage 260A.

As described below in more detail with reference to FIGS. 5A and 5B, the arm 14A is drawn by halyard 228A into a recess in the rotatable part 26A of the banner support assembly 12A and is held in position with arm 14A extending substantially orthogonally from the street pole 200A. The halyard 228A is then attached to the releasable halyard fastener 218A, thereby retaining the banner in the raised configuration shown in FIG. 4. The halyard 228A is preferably a type which will not stretch over time, for example a non-slump rope with a Kevlar core. In the raised position, the arm 14A and banner are preferably located at a height which prevents easy access by a person at ground level. The halyard is securely enclosed within the halyard passage 271A and cannot be accessed except through secure enclosure 212A. In an alternative configuration, the halyard does not pass through the halyard passage 271A but instead passes through a hollow space within the street pole 200A.

When the banner is held in the raised position, movement of the edge of the banner parallel and proximate to the street pole 200A is restrained by tension in cord 280A caused by the influence of gravity on weight 262A. The structure of the elongate passage 260A prevents movement of the weight 262A except in the direction defined by the elongate passage 260A. Weight 262A is preferably of sufficient mass to prevent appreciable movement of the edge of the banner parallel and proximate to the street pole 200A. For example, a 5 kg weight would be sufficient for a 2000×900 mm banner.

In the arrangement shown in FIGS. 4 and 5, the arm 14A may rotate about the axis defined by the mountable part 40A of the banner support assembly 12A so that the raised banner can deflect under wind pressure, spilling the wind and thus limiting the force or bending moment resulting from the wind pressure. The banner may be attached to the weights 256A, 262A and cord 280A by several means, including a toggle and loop arrangement, hooks, carabiners or similar devices.

FIG. 8 depicts a cross sectional view of the elongate passage 260A and weight 262A with eyelet 264A attached. The elongate passage 260A has a longitudinal slot 261A formed in the wall 275. Eyelet 264A protrudes through the longitudinal slot 261A. The sides of the longitudinal slot defined in elongate passage 260A provide some limitation of rotation of the eyelet 264A and consequently the attached banner. The longitudinal slot 261A may thus define a neutral or equilibrium position of the banner when raised on the street pole 200A.

Figure 5A:
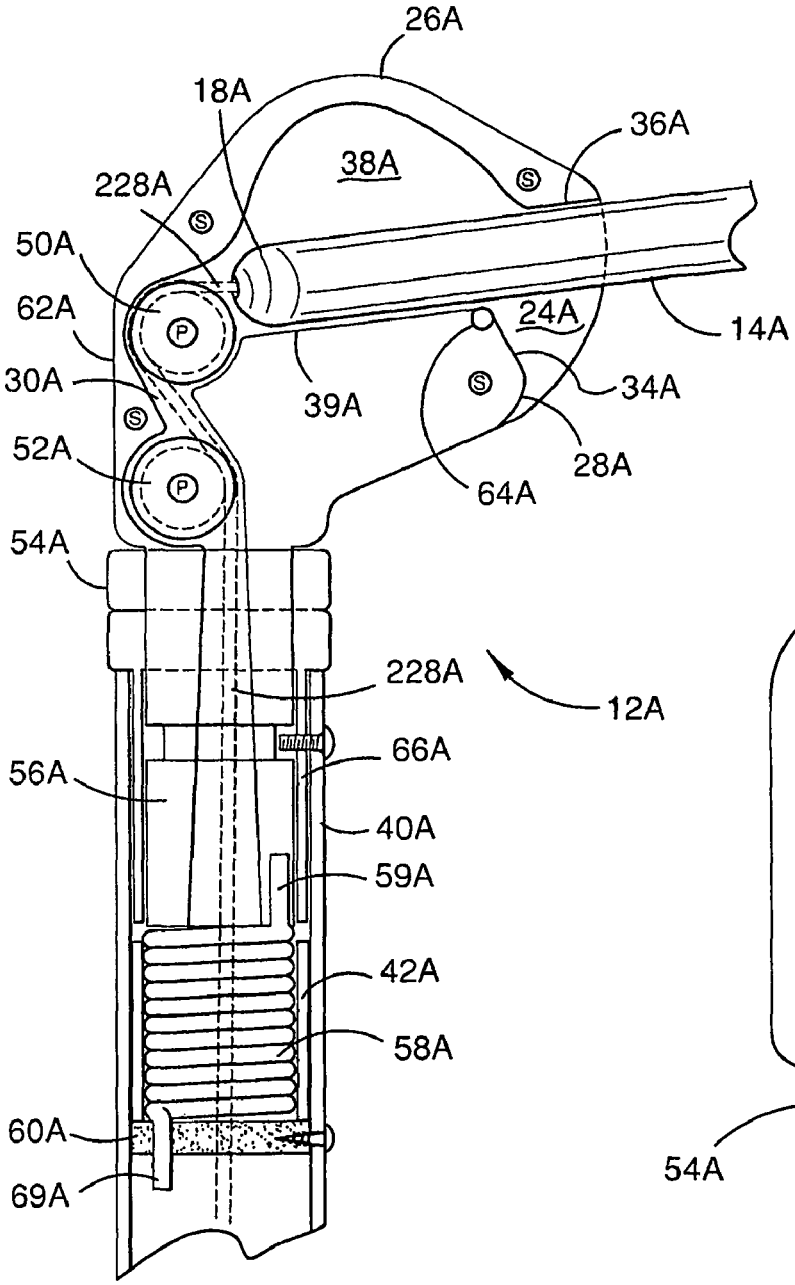
FIG. 5A shows a cut away side view of the banner support assembly of FIG. 4.
Figure 5B:
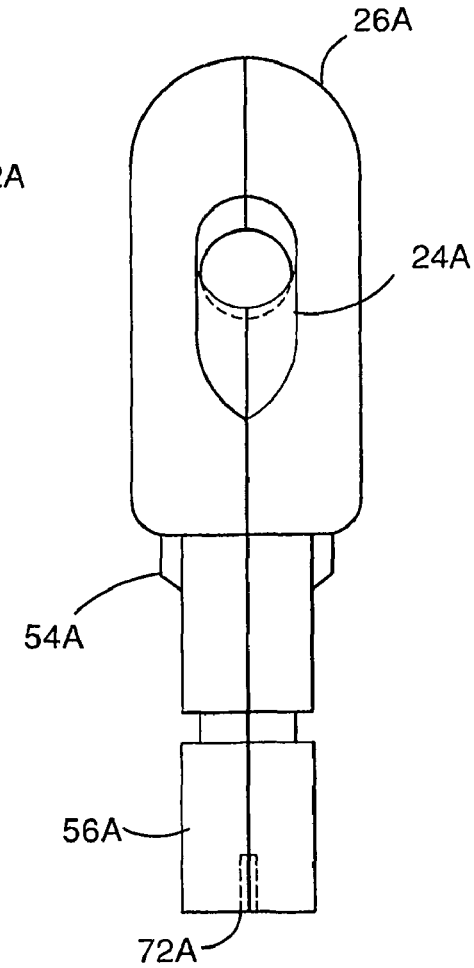
FIG. 5B shows an end view of a banner support assembly.

FIGS. 5A, 5B and 7 show the banner support assembly 12A in greater detail. The banner support assembly 12A includes a rotatable part 26A positioned on a rotator cuff 54A and rotator support 56A which fit into a lower mountable part 40A of the banner support assembly 12A. The mountable part 40A of the banner support assembly 12A may fixed to the street pole 200A by means of screws, rivets or the like.

The rotatable part 26A of the banner support assembly 12A has a flat rear surface 62A that faces the street pole 200A and is positioned approximately 10 mm away from the street pole 200A to enable the rotatable part 26A to rotate. The flat rear surface 62A is shaped to limit the chance of the rotatable part 26A striking the street pole 200A as it rotates. In one arrangement, the expected range of movement of the rotatable part 26A (and hence arm 14A) is less than or equal to 180°. Referring to FIGS. 5A and 7, a torsion spring 58A is provided in the mountable part 40A and acts to bias the orientation of the rotatable part 26A and arm 14A to a neutral or equilibrium position. The arrangement of the banner support assembly 12A with torsion spring 58A allows the banner to move, for example to spill wind, and also tends to return the arm 14A to a neutral or equilibrium position. In the neutral or equilibrium position, the arm 14A extends approximately orthogonally from the street pole 200A. In the neutral or equilibrium position, the longitudinal slot 261A in the elongate passage 260A and the arm 14A define a plane in which the banner is suspended. The elongate passage 260A is generally aligned with a vertical axis of the plane and the arm 14A defines a horizontal axis. In the present description, these axes are used as reference for spatially descriptive terms such as "vertical", "horizontal", "upwards" and "downwards".

Referring to FIG. 5A, the rotatable part 26A of the banner support assembly 12A has an opening 24A defined in a front end of the rotatable part 26A opposite the flat rear surface 62A. The opening 24A has a lower wall 34A and an upper wall 36A. In use, the arm 14A is drawn into the rotatable part 26A through the opening 24A by the halyard 228A. The upper wall 36A and lower wall 34A serve to guide the arm 14A into the interior of the rotatable part 26A of the banner support assembly. In one arrangement, the upper wall is generally horizontal, and the lower wall 34A is angled upwardly and inwardly from the opening 24A. The lower wall 34A has a rounded lower edge 28A towards the exterior that assists in guiding the arm 14A into the rotatable part 26A of the banner support assembly 12A.

Within the rotatable part 26A there is a recess 38A in communication with the opening 24A. The recess 38A has a flat lower surface 39A that is approximately horizontal, or slightly angled upwards towards the opening 24A. When the arm 14A is securely positioned within the rotatable part 26A, the surface 39A and the upper wall 36A of the opening 24A support the arm 14A and define the position of the arm 14A, which is approximately orthogonal to the axis defined by elongate passage 260A. The orientation of the arm 14A need not be exactly orthogonal. For example, the arm 14A may point slightly upwards in an approximate range of 0-10°.

The lower wall 34A extends upwardly and inwardly from lower edge 28A of opening 24A. As the arm 14A is drawn into the rotatable part 26A by halyard 228A, the end 18A of the arm is guided by the angle of lower wall 34A into the recess 38A. In the recess 38A the end 18A of the arm is rotated about point 64A (at the intersection of surface 39A and lower wall 34A) by action of the halyard 228A until the end 18A rests against the flat lower surface 39A. The upper wall 36A of the opening 24A restricts further upward rotation of the arm 14A. The recess 38A has a curved upper surface that has an approximately parabolic shape to accommodate the retraction of arm 14A into the rotatable part 26A and the subsequent vertical rotation of the arm 14A.

From the recess 38A, a guide passage 30A leads downwards through the rotatable part 26A and through the rotator cuff 54A and rotator support 56A into the mountable part 40A of the banner support system 12A. The halyard 228A is attached to the end 18A of the arm 14A. When a downward force is applied to the halyard 228A, the halyard passes through the guide passage 30A of the rotatable part 26A, into the mountable part 40A, into the halyard passage 271A and into the lower enclosure 212A.

Two halyard guides 50A and 52A are provided in the guide passage 30A within the rotatable part 26A of the banner support assembly 12A. The halyard guides 50A, 52A may be wheels or pullies that rotate to reduce friction when the halyard 228A is moved in the guide passage 30A.

To lower the banner, the halyard 228A is released such that arm 14A is lowered closer to the level of the ground where the arm is accessible to a person mounting a banner. The banner is attached to arm 14A and the attachment means on the weights 256A, 262A and glides 258A that move in the elongate passage 260A. To raise the banner, a downward force is applied and the halyard 228A is drawn downwards through the halyard passage 271A. This raises the arm 14A upwardly until end 18A of arm 14A begins to enter opening 24A in the front face of rotatable part 26A. Continued retraction of the halyard 228A causes the end 18A of arm 14A to move into the rotatable part 26A and up along the wall 34A. As the end 18A is drawn further into the recess 38A, the arm pivots about point 64A at the intersection of surfaces 39A and lower wall 34A. Pivoting of the arm 14A continues until the arm 14A comes into contact with the upper wall 36A of the opening 24A. The arm 14A may be retracted into the rotatable part 26A until the arm is brought into contact with the entrance to the guide passage 30A. Preferably the entrance is small enough to prevent the end 18A of arm 14A from entering the guide passage 30A and contacting the halyard guide 50A.

When the halyard 228A is released, the weight of arm 14A and the suspended banner causes arm 14A to rotate about point 64A. End 18A of the arm rises into the recess 38A and, as the halyard is further released, the arm 14 slides out of the rotatable part 26A along the lower wall 34A of the opening 24A.

As seen in FIG. 5A, the rotator support 56A is positioned within the mountable part 40A of the banner support assembly 12A. In addition, the rotator support 56A may be enclosed in a bush 66A within the mountable part 40A. An end 59A of the torsion spring 58A is inserted into a recess 72A in the rotator support 56A. The opposite end 69A of torsion spring 58A is held by a spring holding plate 60A that is attached within the mountable part 40A. A support bush 42A may be positioned in the mountable part 40A around the torsion spring 58A.

The torsion spring 58A is formed from a coiled wire that reacts against a twisting motion. As the rotatable part 26A and arm 14A rotate, for example if a wind is blowing, the rotator support 56A also twists, thereby twisting the end 59A of the torsion spring 58A. The more the spring 58A is twisted, the more force it takes to twist the spring still further. Thus, when the force of the wind eases, the torsion spring 58A acts to return the rotatable part 26A and arm 14A to the neutral or equilibrium position defined by the configuration of the street pole 200A.

FIG. 5B shows an end view of the rotatable part 26A and rotator support 56A. The end view illustrates further how the opening 24A is shaped to provide a channel that guides the end 18A of arm 14A into the rotatable part 26A.

Frictional forces can be reduced by manufacturing the bushes 66A, 42A from suitable plastics materials, for example from a self-lubricating polymer.

Figure 6:
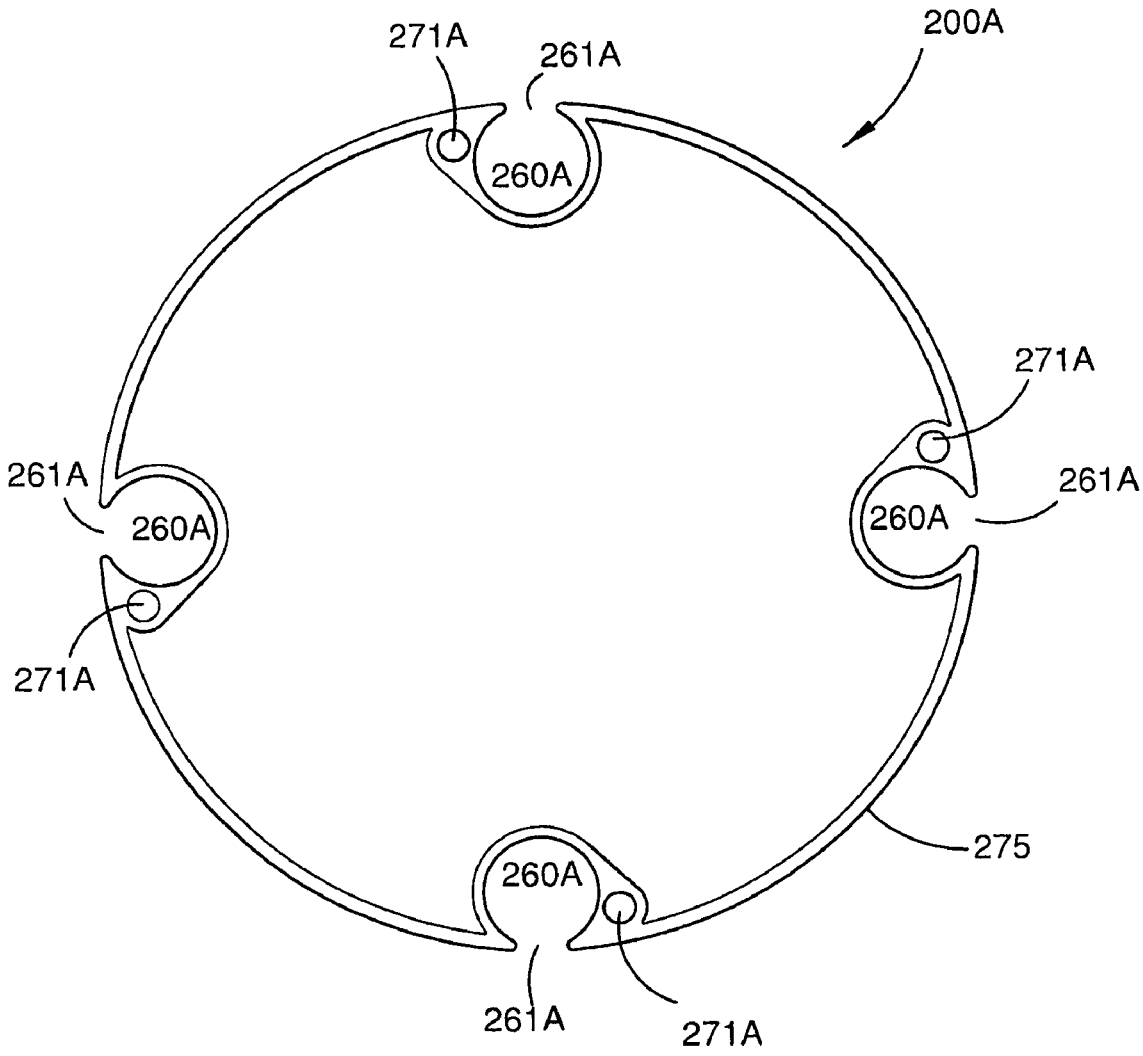
FIG. 6 shows a cross-sectional view along an embodiment of the street pole.

It will be appreciated that the street pole 200A may serve as a conventional municipal pole and as such will typically carry one or more of street lighting, road signs, electrical conduiting, traffic signals, warning lights and the like. Typically the apparatus or item to be mounted to the street pole will be mounted to the pole via slots 261A and passages 260A in a keyhold type mounting arrangement. The pole, in one arrangement shown in FIG. 6, has four vertically extending passages, each of which can be used to mount items thereto in known fashions. The passages 260A may be spaced at regular intervals around the pole 200A. As seen in FIGS. 6 and 8, the passages 260A are associated with a halyard passage 271A. The specific shape of the passages, which allow conventional items and apparatus to be mounted to the pole in addition to travelling weights 256A, 262A, allows the pole to be used for raising and lowering banners. This facility is not possible with mounting slots found in conventional poles.

In the arrangement shown in FIG. 6, the passages 260A and 271A take up a relatively small portion of the interior of the pole 200A. It will be understood that the remainder of the interior may be used for other purposes such as providing power to light fittings mounted on the pole 200A.

It will be understood that the invention disclosed and defined in this specification extends to all alternative combinations of two or more of the individual features mentioned or evident from the text or drawings. All of these different combinations constitute various alternative aspects of the invention.

As used herein, the term "comprise" and variations of the term such as "comprising", "comprises" and "comprised", are not intended to exclude other additives, components, integers or steps.

The invention claimed is:

1. A system for supporting a banner comprising:

(a) a body defining an elongate passage and a secure halyard passage, the elongate passage configured to receive at least one travelling weight and having a longitudinal slot extending substantially along the length of the elongate passage wherein, in use, the banner is attached through the slot to the at least one travelling weight;

(b) a housing positioned at an operatively upper end of the elongate passage and halyard passage, the housing having a recess configured to receive a banner arm wherein, in use, the banner is attached to the banner arm and retraction of a halyard through the secure halyard passage causes the banner arm to be retracted into the recess and to be positioned in a predetermined laterally-extending orientation.

2. A system according to claim 1 wherein the body is a street pole.

3. A system according to claim 2 wherein the street pole defines a hollow core and the elongate passage and the secure halyard passage are separate from the hollow core.

4. A system according to claim 1 comprising a plurality of elongate passages and secure halyard passages.

5. A system according to claim 1 wherein the body comprises a conduit adapted to be mounted to a support surface so as to extend generally vertically along the support surface.

6. A system according to claim 1 wherein the housing defines a space above an end portion of the banner arm when the banner arm is retracted into the housing and is in the predetermined orientation, the space being sized such that the end portion of the banner arm enters the space during retraction of the banner arm into the housing and during release of the arm from the predetermined orientation.

7. A system according to claim 1 wherein the housing comprises a rotatable part that rotates about an axis generally aligned with the elongate passage.

8. A system according to claim 7 wherein the rotatable part has an equilibrium position and the housing comprises means for resisting rotation of the housing away from the equilibrium position.

9. A system according to claim 8 wherein the means for resisting rotation is a torsion spring that exerts a torque on the housing, wherein the exerted torque is a function of a degree of rotation away from the equilibrium position.

10. A system according to claim 1 comprising a secure enclosure located at an operatively lower end of the halyard passage and containing a halyard fastener for releasably attaching the halyard.

11. A system according to claim 1 wherein releasing the halyard causes the banner arm to leave the recess and descend along the body dependent on a length of released halyard.

12. A system according to claim 1 comprising a link connecting the banner arm and the at least one travelling weight.

13. A street pole adapted to support one or more electrical fittings, signals, signs, lights, or electrical conduits, and also adapted to support a banner, the street pole comprising:

a cylindrical self-supporting wall defining a hollow core, the wall being shaped to define at least one vertically extending elongate passage which is configured to receive a travelling weight, the elongate passage having a longitudinal slot open to the exterior of the street pole extending the length of the elongate passage;

at least one halyard passage configured to receive a halyard, the halyard passage extending the length of the elongate passage and being separate from the hollow core and the elongate passage; and at least one banner support assembly mounted at an upper end of a corresponding halyard passage, said banner support assembly comprising:

(1) a rotatable part having a recess configured to receive a banner arm;

(2) a mountable part fixed to the street pole, the rotatable part being rotatable relative to the mountable part about a generally vertical axis; and (3) a guide passage extending through the two parts which is contiguous with the halyard passage such that retraction of the halyard through the guide passage and into the halyard passage causes an end of the banner arm to be retracted into the recess so that the banner arm is positioned in a predetermined laterally-extending orientation for displaying a banner.

14. A street pole according to claim 13 wherein the at least one vertically extending elongate passage comprises four vertically extending elongate passages equally spaced around the wall, and each elongate passage is provided with a corresponding at least one halyard passage.

15. A street pole according claim 13 further comprising at least one secure enclosure located at an operatively lower end of a corresponding halyard passage, the enclosure containing a halyard fastener for releasably attaching the halyard.

16. An apparatus for raising and lowering a banner, the apparatus comprising:

(a) an elongate conduit defining a secure halyard passage, the conduit adapted to be mounted to a support surface so as to extend generally vertically along the support surface;

(b) a secure enclosure located at an operatively lower end of the elongate conduit and containing a halyard fastener for releasably attaching a halyard;

(c) an arm for attaching the banner thereto, wherein in use the arm is attached to the halyard that passes through the secure halyard passage to the secure enclosure; and (d) a housing located at an operatively upper end of the elongate conduit, the housing having a passage therethrough, wherein retraction of the halyard through the passage and the secure halyard passage causes the arm to be retracted into the housing and to be positioned in a predetermined laterally-extending orientation for displaying the banner.

* * * * *